US011229568B2

(12) United States Patent
Ribble et al.

(10) Patent No.: US 11,229,568 B2
(45) Date of Patent: Jan. 25, 2022

(54) MATTRESS SUPPORT FOR ADDING HOSPITAL BED FUNCTIONALITY TO AN IN-HOME BED

(71) Applicant: Hill-Rom Services, Inc., Batesville, IN (US)

(72) Inventors: David L. Ribble, Batesville, IN (US); Craig M. Meyerson, Syracuse, NY (US); Lori Zapfe, Milroy, IN (US); Xuan Teng, Batesville, IN (US); Jotpreet Chahal, Fayetteville, NY (US); Thomas F. Heil, Batesville, IN (US); Kirsten M. Emmons, Batesville, IN (US); David L. Bedel, Oldenburg, IN (US); Kenneth L. Lilly, West Chester, OH (US); Nicholas Mann, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 134 days.

(21) Appl. No.: 16/583,315

(22) Filed: Sep. 26, 2019

(65) Prior Publication Data

US 2020/0100968 A1 Apr. 2, 2020

Related U.S. Application Data

(60) Provisional application No. 62/739,340, filed on Sep. 30, 2018.

(51) Int. Cl.
*A61G 7/10* (2006.01)
*A47C 20/04* (2006.01)
(Continued)

(52) U.S. Cl.
CPC ..... *A61G 7/1021* (2013.01); *A47C 20/04* (2013.01); *A61G 7/00* (2013.01); *A61G 7/002* (2013.01);
(Continued)

(58) Field of Classification Search
CPC ..... A61G 7/1021; A61G 7/002; A61G 7/00; A61G 7/005; A61G 7/1013; A61G 7/0514; A61G 7/0515; A61G 7/0516; A47C 20/04
See application file for complete search history.

(56) References Cited

U.S. PATENT DOCUMENTS 948,644 A 2/1910 Bjornstad
1,610,898 A 12/1926 Steiner
(Continued)

FOREIGN PATENT DOCUMENTS

DE 1987293 A1 6/1968
EP 1180352 A1 * 2/2002 ..... A61H 1/0222
(Continued)

OTHER PUBLICATIONS

"Hinge." Merriam-Webster, Merriam-Webster, www.merriam-webster.com/dictionary/hinge.*
(Continued)

*Primary Examiner* — David R Hare
*Assistant Examiner* — Madison Emanski
(74) *Attorney, Agent, or Firm* — Barnes & Thornburg LLP

(57) ABSTRACT

A mattress support includes a base plate configured to be positioned on a box spring of a bed. A bladder may be coupled to a top surface of the base plate. A top plate is coupled to a top surface of the bladder. A top surface of the top plate is configured to support a mattress. The bladder is inflatable to adjust a height of the top plate.

21 Claims, 5 Drawing Sheets

(51) Int. Cl.
*A61G 7/00* (2006.01)
*A61G 7/002* (2006.01)
*A61G 7/05* (2006.01)

(52) U.S. Cl.
CPC ..... *A61G 7/0513* (2016.11); *A61G 7/0514* (2016.11); *A61G 7/0516* (2016.11)

(56) References Cited

U.S. PATENT DOCUMENTS 2,612,645 A 10/1952 Boland
2,887,692 A 5/1959 Gosman
3,392,412 A 7/1968 Aymar
3,426,373 A 2/1969 Scott et al.
3,606,623 A 9/1971 Aymar et al.
3,667,075 A 6/1972 Ballard
3,781,928 A 1/1974 Swallert
4,142,263 A 3/1979 Pierson
4,150,284 A 4/1979 Trenkler et al.
4,151,407 A 4/1979 Delagi et al.
4,165,125 A 8/1979 Owen
4,183,015 A 1/1980 Drew et al.
4,216,462 A 8/1980 DiGiacomo et al.
4,225,953 A 9/1980 Simon et al.
4,228,426 A 10/1980 Roberts
4,237,344 A 12/1980 Moore
4,298,863 A 11/1981 Natitus et al.
4,309,783 A 1/1982 Cammack et al.
4,331,953 A 5/1982 Blevins et al.
4,527,298 A 7/1985 Moulton
4,542,547 A 9/1985 Sato
4,554,693 A 11/1985 Calloway
4,577,185 A 3/1986 Andersen
4,578,671 A 3/1986 Flowers
4,593,273 A 6/1986 Narcisse
4,598,275 A 7/1986 Ross et al.
4,601,064 A 7/1986 Shipley
4,649,385 A 3/1987 Aires et al.
4,680,790 A 7/1987 Packard et al.
4,814,751 A 3/1989 Hawkins et al.
4,839,932 A 6/1989 Williamson
4,850,040 A 7/1989 Teich et al.
4,877,288 A 10/1989 Lee
4,932,089 A 6/1990 Laviero
4,955,000 A 9/1990 Nastrom
4,967,195 A 10/1990 Shipley
4,990,892 A 2/1991 Guest et al.
4,998,095 A 3/1991 Shields
4,998,939 A 3/1991 Potthast et al.
5,012,539 A 5/1991 Grigg
5,036,852 A 8/1991 Leishman
5,060,174 A 10/1991 Gross
5,062,151 A 10/1991 Shipley
5,065,154 A 11/1991 Kaiser et al.
5,086,290 A 2/1992 Murray et al.
5,103,108 A 4/1992 Crimmins
5,124,991 A 6/1992 Allen
5,137,033 A 8/1992 Norton
5,144,284 A 9/1992 Hammett
5,153,584 A 10/1992 Engira
5,170,522 A 12/1992 Walker
5,184,112 A 2/1993 Gusakov
5,195,198 A 3/1993 Travis
5,253,656 A 10/1993 Rincoe et al.
5,269,388 A 12/1993 Reichow et al.
5,276,432 A 1/1994 Travis
5,311,625 A 5/1994 Barker et al.
5,345,630 A 9/1994 Healy
5,353,012 A 10/1994 Barham et al.
5,415,167 A 5/1995 Wilk
5,432,967 A 7/1995 Raftery
5,490,295 A 2/1996 Boyd
5,528,783 A * 6/1996 Kunz ..... A47C 20/048 5/615
5,577,278 A 11/1996 Barker et al.
5,621,931 A 4/1997 Hamilton
5,715,548 A 2/1998 Weismiller et al.
5,838,223 A 11/1998 Gallant et al.
5,844,488 A 12/1998 Musick
5,867,821 A 2/1999 Ballantyne et al.
5,877,675 A 3/1999 Rebstock et al.
5,933,488 A 8/1999 Marcus et al.
5,936,539 A 8/1999 Fuchs
5,942,986 A 8/1999 Shabot et al.
5,944,659 A 8/1999 Flach et al.
5,963,137 A 10/1999 Waters
6,009,873 A 1/2000 Neviaser
6,093,146 A 7/2000 Filangeri
6,097,308 A 8/2000 Albert et al.
6,111,509 A 8/2000 Holmes
6,125,350 A 9/2000 Dirbas
6,131,219 A 10/2000 Roberts
6,133,837 A 10/2000 Riley
6,142,592 A 11/2000 Grittke et al.
6,183,417 B1 2/2001 Geheb et al.
6,208,250 B1 3/2001 Dixon et al.
6,397,416 B2 6/2002 Brooke et al.
6,684,425 B2 2/2004 Davis
7,154,397 B2 12/2006 Zerhusen et al.
7,568,246 B2 8/2009 Weismiller et al.
7,669,263 B2 3/2010 Menkedick et al.
7,690,059 B2 4/2010 Lemire et al.
7,852,208 B2 12/2010 Collins, Jr. et al.
8,536,990 B2 9/2013 Collins, Jr. et al.
8,656,541 B2 2/2014 Muollo
8,789,224 B2 7/2014 Wyatt et al.
2003/0041378 A1 3/2003 Davis
2003/0150058 A1 8/2003 Davis
2003/0196270 A1 10/2003 Leventhal et al.
2005/0278861 A1* 12/2005 Kasatshko ..... A47C 20/048 5/713
2006/0117482 A1 6/2006 Branson
2006/0123550 A1 6/2006 Davis
2006/0230539 A1 10/2006 Goodman
2008/0147442 A1 6/2008 Warner et al.
2016/0331616 A1 11/2016 Fisk et al.
2018/0333082 A1 11/2018 Hoffman et al.

FOREIGN PATENT DOCUMENTS

JP S5438512 U 3/1979
JP H01238859 A 9/1989
JP H04297257 A 10/1992
WO WO-0057829 A1 * 10/2000 ..... A61G 7/015
WO 2013134638 A1 9/2013
WO 2014117128 A1 7/2014

OTHER PUBLICATIONS

Extended European Search Report, European Application No. 19200203.8, completed Nov. 20, 2019, (7 pages).

* cited by examiner

MATTRESS SUPPORT FOR ADDING HOSPITAL BED FUNCTIONALITY TO AN IN-HOME BED

PRIORITY CLAIM

This application claims priority under 35 U.S.C. § 119(e) to U.S. Provisional Application No. 62/739,340, filed Sep. 30, 2018, which is expressly incorporated by reference herein.

TECHNICAL FIELD

The present disclosure relates to a bed assembly for use during at-home care. More specifically, the present disclosure relates to a bed assembly that elevates the head section of the traditional consumer mattress.

BACKGROUND

The present disclosure is related to a bed assembly. Specifically, the present disclosure relates to a bed assembly that is compatible with a traditional consumer bed and can enhance the traditional consumer bed so it provides features of a traditional hospital bed. Such features include the ability to elevate the head section of the traditional consumer mattress using a mattress support having inflatable air bladders.

Extended hospitalization of a patient is an ongoing challenge due to the high cost incurred by the patient and the hospital. At-home care is also challenging due to the high cost, difficulty, and complexity of equipping the home for patient care. While several systems and methods exist for equipping the home for patient care, opportunity exists for continued development in this area. Where a mattress support is used on a larger (e.g., queen sized) mattress, the mattress support must be as wide as the entire mattress (e.g., 60"). Unfortunately, a mattress support that wide would be expensive to ship and challenging for a healthcare professional, family member, or patient to transport or lift. Additionally, dividing that mattress support into two sections would make it difficult to place the mattress support under the mattress, as it could not be inserted in between the mattress and box springs from one side. Moreover, connecting the components once under the mattress would be problematic.

Another problem involved with mattress supports is that a mattress generally has the same amount of friction in any direction, making it difficult to slide the mattress support under the mattress. There is a need to simplify the insertion of the mattress support underneath the mattress, while also keeping the mattress support in place once inserted.

SUMMARY

The present disclosure includes one or more of the features recited in the appended claims and/or the following features which, alone or in any combination, may comprise patentable subject matter.

According to an aspect of the disclosed embodiments, a mattress support includes a base plate configured to be positioned on a box spring of a bed. A bladder may be coupled to a top surface of the base plate. A top plate may be coupled to a top surface of the bladder. A top surface of the top plate may be configured to support a mattress. The bladder may be inflatable to adjust a height of the top plate.

The top plate may include a coupling mechanism that enables the mattress support to be folded.

It may be desired that the top plate includes a first half coupled to a second half by the coupling mechanism. The bladder may include a first bladder coupled to the first half of the top plate and a second bladder coupled to the second half of the top plate. The base plate may include a first half coupled to the first bladder and a second half couple to the second bladder. When the mattress support is folded, a top surface of the first half of the top plate may be positioned adjacent to a top surface of the second half of the top plate. When the mattress is folded, the first bladder and the first half of the base plate may be positioned adjacent the first half of the top plate and the second bladder and the second half of the base plate may be positioned adjacent the second half of the top plate. A first side panel may be coupled to the first half of the top plate. The first side panel may be configured to couple to a first side rail. A second side panel may be coupled to the second half of the top plate. The second side panel may be configured to couple to a second side rail.

In some embodiments, the bladder may be inflated to adjust an angle of the top plate relative to a longitudinal axis of the mattress support.

It may be contemplated that the coupling mechanism includes an interlocking joint or a hinge.

Alternatively or additionally, a side panel may be coupled to the top plate. The side panel may be configured to couple to a side rail. The side panel may include a first side panel coupled to a first side of the top plate. The first side panel may be configured to couple to a first side rail. A second side panel may be coupled to a second side of the top plate. The second side panel may be configured to couple to a second side rail.

Optionally, a runner may extend along the top surface of the top plate. The runner may extend laterally along the top surface of the top plate. A plurality of runners may extend laterally along the top surface of the top plate.

According to another aspect of the disclosed embodiments, a mattress support includes a base plate configured to be positioned on a box spring of a bed. The base plate may have a first half and a second half. A first elevation assembly may be coupled to the first half of the base plate and a second elevation assembly may be coupled to the second half of the base plate. A top plate may have a first half and a second half. The first half of the top plate may be coupled to the first elevation assembly and the second half of the top plate may be coupled to the second elevation assembly. A coupling mechanism may couple the first half of the top plate and the second half of the top plate to enable the mattress support to be folded.

In some embodiments, the first elevation assembly may be a first bladder and the second elevation assembly may be a second bladder. The first bladder and the second bladder may be inflated to adjust an angle of the top plate relative to a longitudinal axis of the mattress support.

Optionally, the coupling mechanism may include an interlocking joint or a hinge.

It may be contemplated that, when the mattress support is folded, a top surface of the first half of the top plate may be positioned adjacent to a top surface of the second half of the top plate. When the mattress is folded, the first elevation assembly and the first half of the base plate may be positioned adjacent the first half of the top plate and the second elevation assembly and the second half of the base plate may be positioned adjacent the second half of the top plate.

Alternatively or additionally, a first side panel may be coupled to the first half of the top plate. A second side panel may be coupled to the second half of the top plate. The first side panel may be configured to couple to a first side rail. The second side panel may be configured to couple to a second side rail.

It may be desired that a runner extends along the top surface of the top plate. The runner may extend laterally along the top surface of the top plate. A plurality of runners may extend laterally along the top surface of the top plate.

BRIEF DESCRIPTION OF THE DRAWINGS

The detailed description particularly refers to the accompanying figures in which.

DETAILED DESCRIPTION

Figure 1:
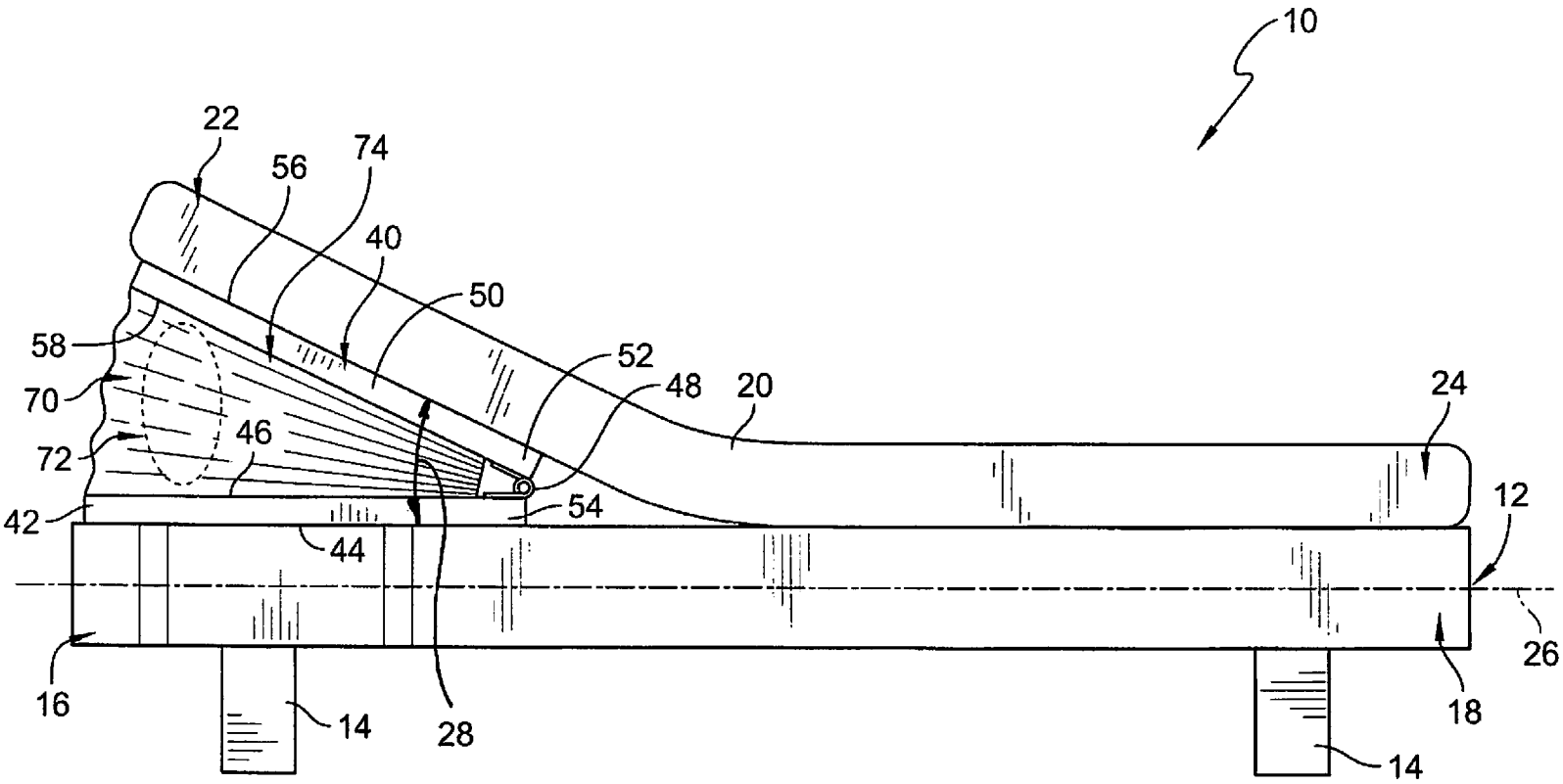
FIG. 1 is side elevation view of a bed assembly having a mattress support positioned between a frame and a mattress.

An illustrative bed assembly 10 is shown in FIG. 1. The bed assembly 10 includes a frame 12 or box spring that is supported on the floor with legs 14. The frame 12 includes a head end 16 and a foot end 18. A mattress 20 is positioned on the frame 12 and extends between the head end 16 and the foot end 18 of the frame 12. A head end 22 of the mattress 20 is positioned at the head end 16 of the frame 12, and a foot end 24 of the mattress 20 is positioned at the foot end 18 of the frame 12. At least one of the head end 22 and the foot end 24 of the mattress 20 is moveable to angle relative to a longitudinal axis 26 of the frame 12. That is, the head end 22 and the foot end 24 of the mattress 20 may be raised relative to the frame 12. FIG. 1 illustrates the head end 22 in a raised position at an angle 28 relative to the longitudinal axis 26 of the frame 12.

A mattress support 40 is positioned between the head end 16 of the frame 12 and the head end 22 of the mattress 20 to raise the head end 22 of the mattress 20. The mattress support 40 includes a base plate 42 having a bottom surface 44 and a top surface 46. The bottom surface 44 of the base plate 42 is positioned in contact with the frame 12. The top surface 46 of the base plate 42 faces upward from the frame 12. A top plate 50 is coupled to the base plate 42. An end 52 of the top plate 50 is coupled to an end 54 of the base plate 42 via a hinge 48 so that the top plate 50 is rotatable relative to the base plate 42 about the ends 52 and 54. The top plate 50 includes a top surface 56 and a bottom surface 58. The head end 22 of the mattress 20 is positioned on the top surface 56 of the top plate 50. The bottom surface 58 of the top plate 50 faces downward from the mattress 20.

An elevation assembly 70 is positioned between the base plate 42 and the top plate 50. The elevation assembly 70 is coupled to the bottom surface 58 of the top plate 50 and the top surface 46 of the base plate 42. In the illustrative embodiment, the elevation assembly 70 includes an air bladder 72 positioned within an expandable envelope 74. In some embodiments, the elevation assembly 70 may include a plurality of air bladders 72 positioned within an expandable envelope 74. The air bladder 72 is inflatable to angle the top plate 50 relative to the base plate 42, thereby raising the head end 22 of the mattress 20.

Figure 2:
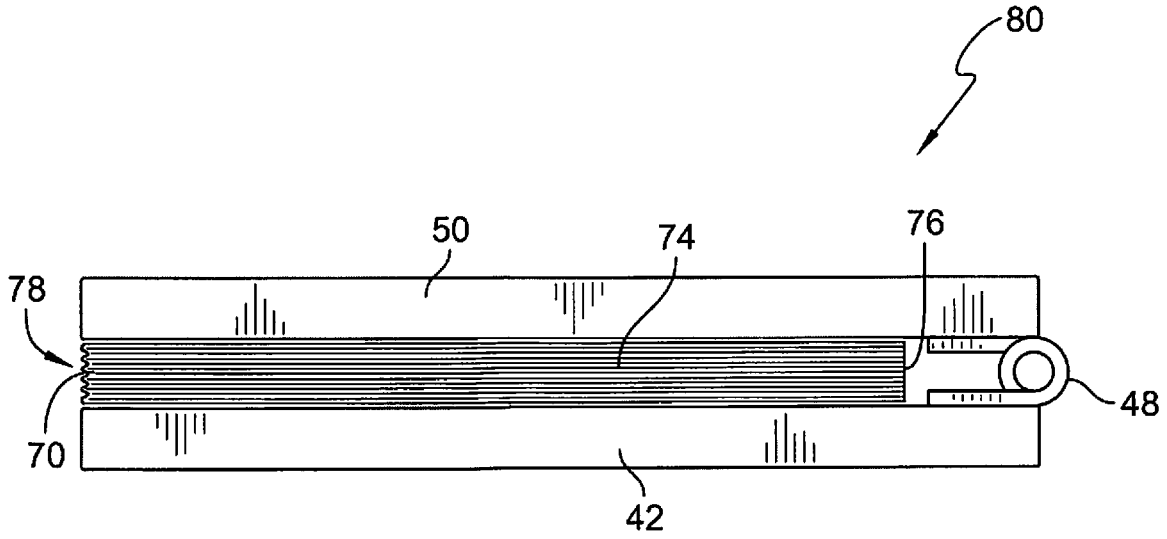
FIG. 2 is a side elevation view of the mattress support shown in FIG. 1 in a lowered position.
Figure 3:
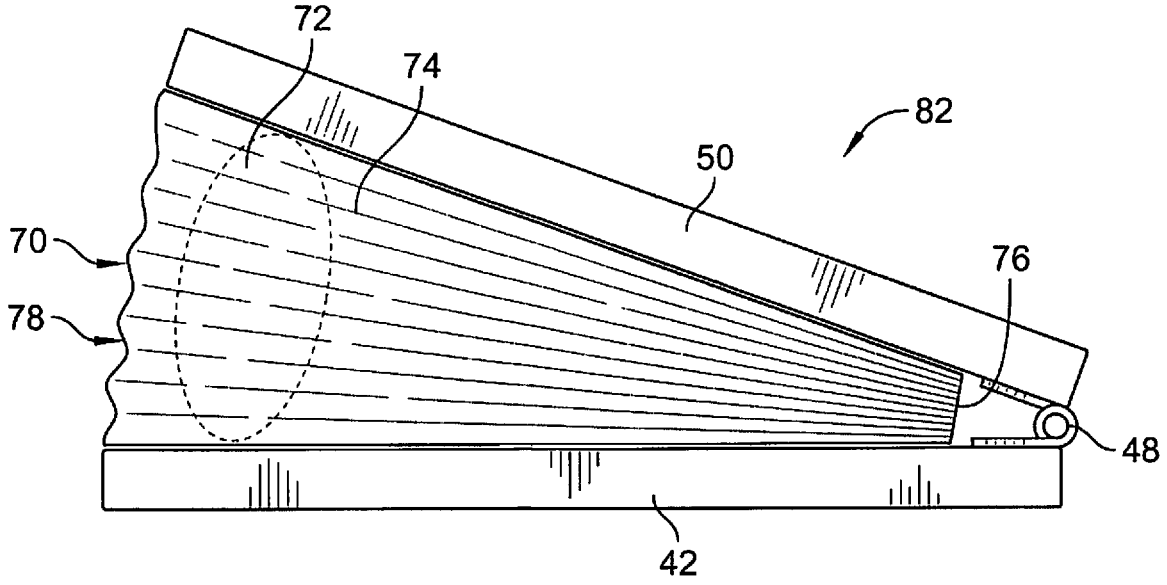
FIG. 3 is a side elevation view of the mattress support shown in FIG. 1 in a raised position.

Referring to FIGS. 2 and 3, the envelope 74 includes a fixed end 76 at the ends 52 and 54 of the top plate 50 and the base plate 42, respectively. The envelope 74 also includes an expandable end 78 that is configured as an accordion sleeve that expands and contracts. In some embodiments, the structure of the elevation assembly 70 may be embodied similarly to the z-plate assemblies 2044 and 2064 shown in PCT Publication No. WO2016/196403, titled "Patient Support Apparatus." Similarly, the bladder 72 may be embodied similarly to the turn bladder assemblies 2034 and 2036 shown in the PCT Publication No. WO2016/196403, titled "Patient Support Apparatus." The PCT Publication No. WO2016/196403, titled "Patient Support Apparatus" is incorporated by reference herein for the disclosure of a structure suitable to lift portions of a mattress.

The elevation assembly 70 raises and lowers the mattress support 40 between a lowered position 80, shown in FIG. 2, and a raised position 82, shown in FIG. 3. Notably, the mattress support 40 may be raised or lowered to any intermediate position between the lowered position 80 and the raised position 82.

Figure 4:
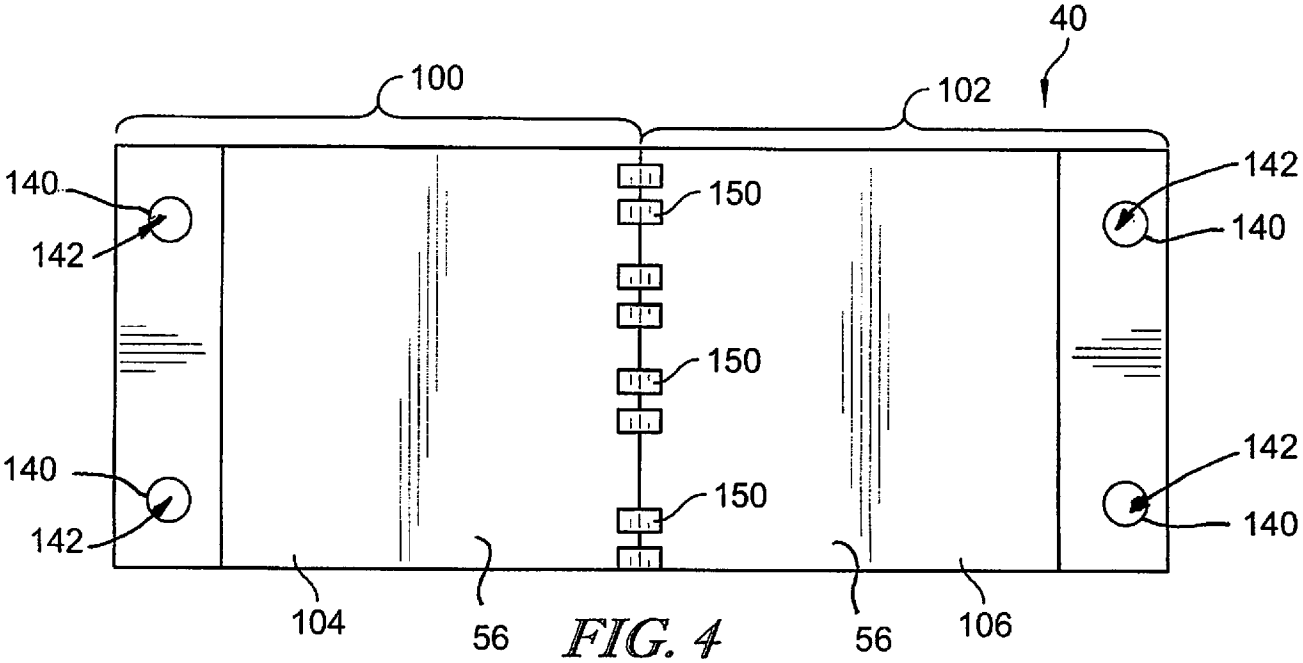
FIG. 4 is a top plan view of the mattress support shown in FIG. 1.
Figure 5:
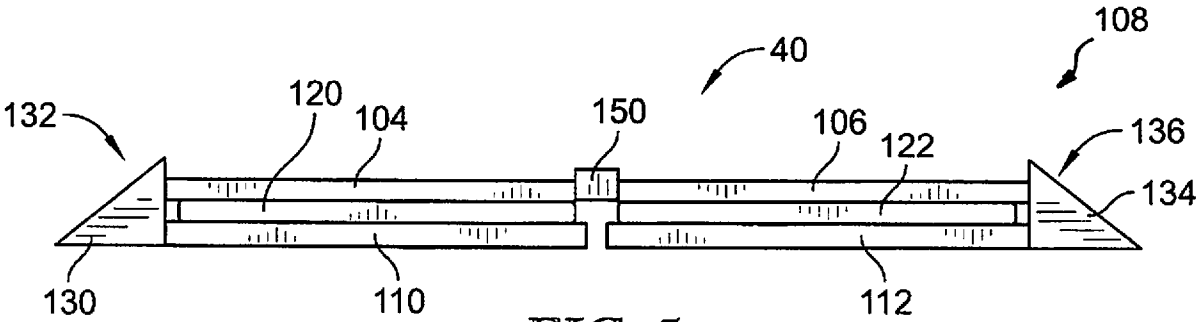
FIG. 5 is a side elevation view of the mattress support shown in FIG. 1 in a flat configuration.

Referring to FIGS. 4 and 5, the mattress support 40 includes a left half 100 and a right half 102, shown in a flat configuration 108. The top plate 50 includes a left top plate 104 in the left half 100 of the mattress support 40 and a right top plate 106 in the right half 102 of the mattress support 40. The base plate 42 includes a left base plate 110 positioned below the left top plate 104 and a right base plate 112 positioned below the right top plate 106. A left elevation assembly 120 is coupled between the left top plate 104 and the left base plate 110. A right elevation assembly 122 is coupled between the right top plate 106 and the right base plate 112. The left elevation assembly 120 is configured to raise the left top plate 104 relative to the left base plate 110. The right elevation assembly 122 is configured to raise the right top plate 106 relative to the right base plate 112. The left elevation assembly 120 and the right elevation assembly 122 may be actuated simultaneously or separately.

A left side panel 130 is coupled to the left top plate 104 on a left side 132 of the mattress support 40, and a right side panel 134 is coupled to the right top plate 106 on a right side 136 of the mattress support 40. The panels 130 and 134 are configured to receive a side rail. That is, a side rail bracket (not shown) is configured to couple to each of the panels 130 and 134. Each panel 130 and 134 includes apertures 140 extending from openings 142 formed in the panel 130, 134. The apertures 140 are configured to receive the side rail bracket. The panels 130 and 134 are configured to raise with the respective left top plate 104 and right top plate 106 to raise the side rail with the head end 22 of the mattress 20.

Figure 6:
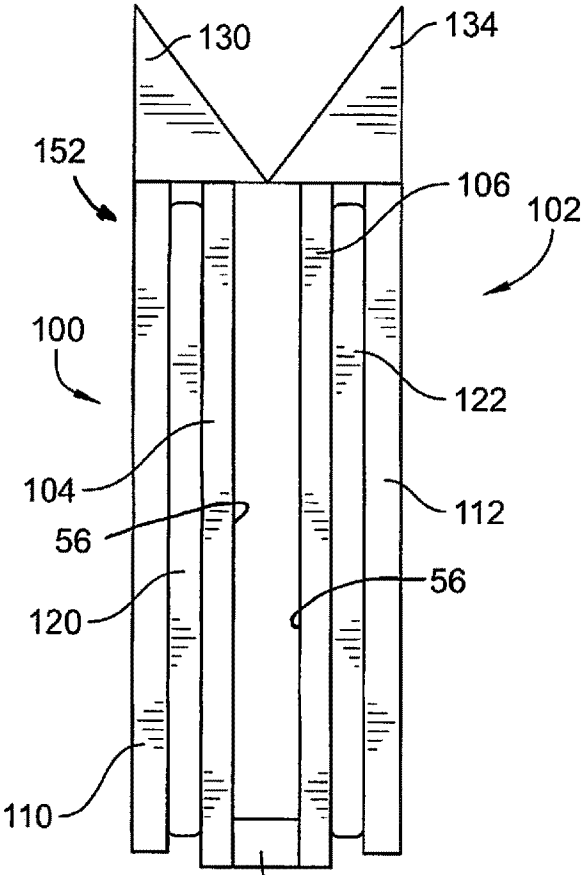
FIG. 6 is a side elevation view of the mattress support shown in FIG. 1 in a folded configuration.

A coupling mechanism 150 secures the left top plate 104 to the right top plate 106 so that the left half 100 and the right half 102 of the mattress support 40 can be folded into the folded configuration 152 shown in FIG. 6. In the folded configuration 152, the top surface 56 of the left top plate 104 is positioned adjacent the top surface 56 of the right top plate 106. The left elevation assembly 120 and the left base plate 110 are positioned adjacent the left top plate 104, and the right elevation assembly 122 and the right base plate 112 are positioned adjacent the right top plate 106.

Figure 7:
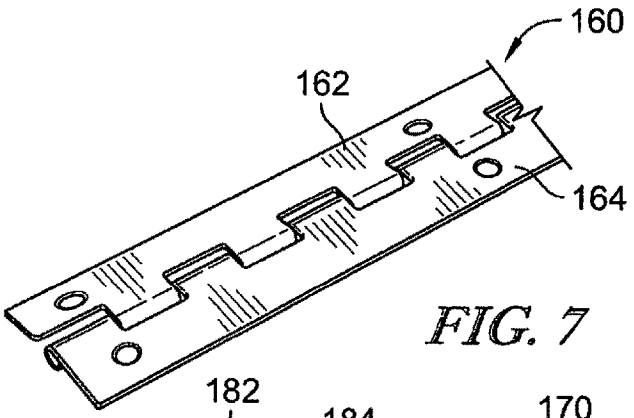
FIG. 7 is a perspective view of an exemplary coupling mechanism that may be used with the mattress support shown in FIG. 1.

Referring to FIG. 7, in some embodiments, the coupling mechanism 150 is a hinge 160 having a left flange 162 and a right flange 164 that are coupled so that the left flange 162 and the right flange 164 rotate relative to one another. The left flange 162 is coupled to the left top plate 104, and the right flange 164 is coupled to the right top plate 106. The hinge 160 enables the left top plate 104 to rotate relative to the right top plate 106 between the flat configuration 108 and the folded configuration 152.

Figure 8:
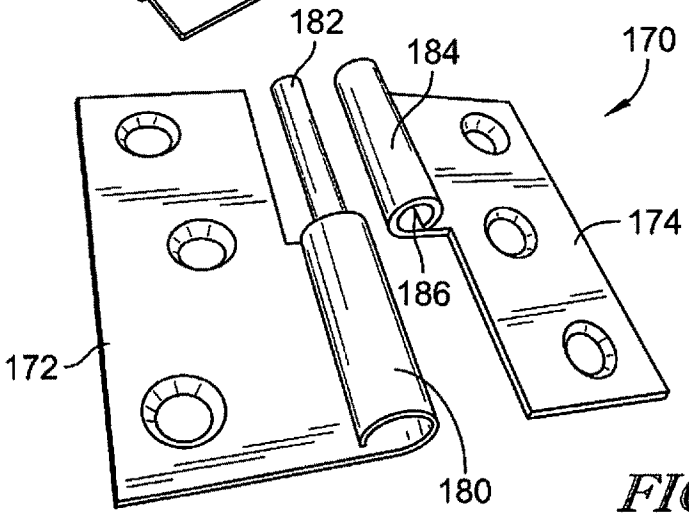
FIG. 8 is a perspective view of another exemplary coupling mechanism that may be used with the mattress support shown in FIG. 1.

Referring to FIG. 8, in some embodiments, the coupling mechanism 150 is a mating hinge 170 having a left flange 172 and a right flange 174. The left flange 172 is configured to couple to the left top plate 104, and the right flange 174 is configured to couple to the right top plate 106. The left flange 172 includes a cylinder 180 having a pin 182, and the right flange 174 includes a cylinder 184 having an aperture 186. The aperture 186 is configured to receive the pin 182 to couple the left flange 172 to the right flange 174. Accordingly, the left top plate 104 may be coupled to the right top plate 106 by coupling the left flange 172 to the right flange 174. The left top plate 104 and the right top plate 106 may then be articulated between the flat configuration 108 and the folded configuration 152 about the mating hinge 170. In some embodiments, the left flange 172 of the mating hinge 170 may be separated from the right flange 174 of the mating hinge 170 to separate the left top plate 104 and the right top plate 106. The left top plate 104 and the right top plate 106 may then be positioned in the folded configuration 152. When articulating the mattress support 40 to the flat configuration 108, the left top plate 104 is coupled to the right top plate 106 may mating the left flange 172 of the mating hinge 170 and the right flange 174 of the mating hinge 170.

Figure 9:
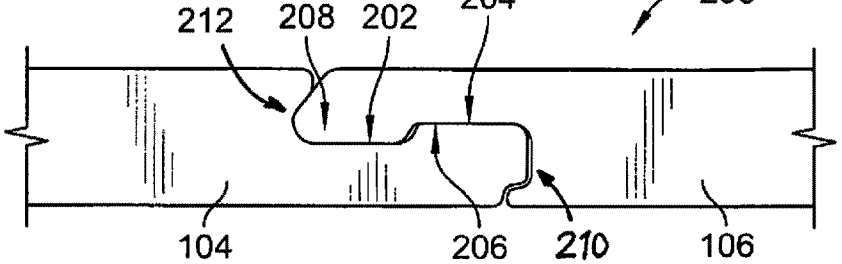
FIG. 9 is a perspective view of yet another exemplary coupling mechanism that may be used with the mattress support shown in FIG. 1.

Referring to FIG. 9, in some embodiments, the coupling mechanism 150 is an interlocking joint 200. The interlocking joint 200 includes a notch 202 and a tab 204 formed on the left top plate 104, and a notch 206 and a tab 208 formed on the right top plate 106. The tab 204 is formed on an outer edge 210 of the left top plate 104. The notch 202 is positioned inward of and adjacent to the tab 204. The tab 208 is formed on an outer edge 212 of the right top plate 106. The notch 206 is positioned inward of and adjacent to the tab 208. The outer edge 210 of the left top plate 104 is configured to be positioned adjacent to the outer edge 212 of the right top plate 106, so that the notches 202, 206 and the tabs 204, 208 can be mated. That is, the tab 204 is positioned within the notch 206 and the tab 208 is positioned within the notch 202 to lock the left top plate 104 to the right top plate 106 to position the mattress support 40 in the flat configuration 108. When articulating the mattress support 40 to the folded configuration 152, the tabs 204, 208 are removed from the respective notches 202, 206 to separate the left half 100 and the right half 102 of the mattress support 40. When separated, the left half 100 and the right half 102 can be positioned in the folded configuration 152.

Figure 10:
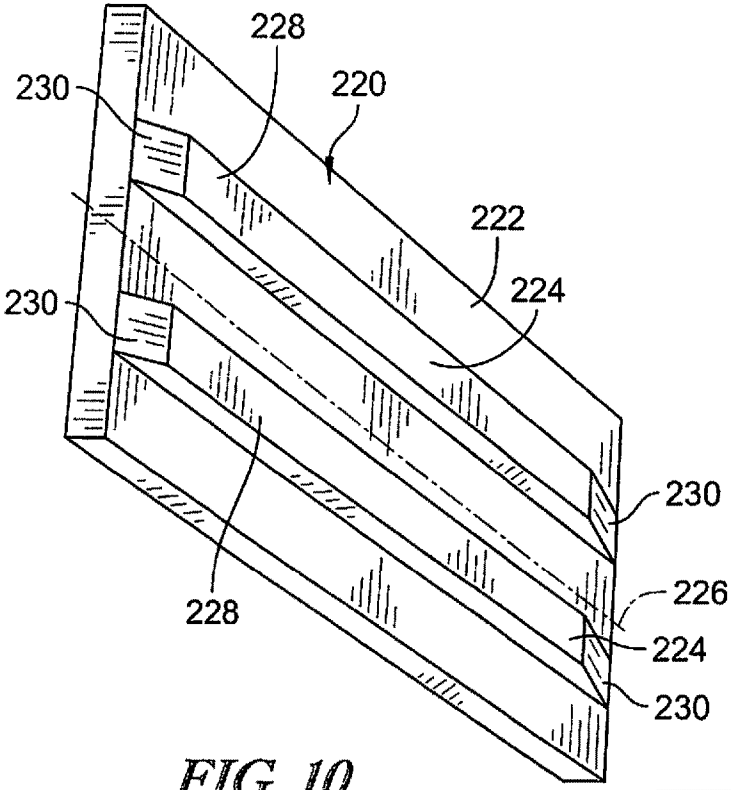
FIG. 10 is a perspective view of an exemplary top plate that may be used with the mattress support shown in FIG. 1.

Referring to FIG. 10, an embodiment of a top plate 220 for the mattress support 40 is illustrated. The top plate 220 may be the left top plate 104 or the right top plate 106. The top plate 220 includes a top surface 222 having a plurality of runners 224 extending parallel to a lateral axis 226. Although two runners 224 are illustrated, the top plate 220 may have any number of runners 224, including only one or more than two. The runners 224 extend outward from the top surface 222. The runners 224 include a smooth top surface 228, e.g. a plastic surface, smoothed wood, or the like. Each runner 224 includes a pair of sloped sides 230. When positioning the mattress support 40 under the mattress 20, the mattress support 40 is inserted between the mattress 20 and the frame 12 from a side of the bed 10 so that the mattress support 40 is pushed under the mattress 20 along the lateral axis 226 of the mattress support 40. The sloped sides 230 of the runners 224 enable the mattress support 40 to be slid under the mattress 20. The top surface 228 of each runner 224 reduces a friction between the top plate 220 and the mattress 20 so that a patient, a family member, or a healthcare provider can slide the mattress support 40 under the mattress 20.

Notably, when the mattress support 40 is positioned under the mattress 20, the runners 224 increase a friction between the top plate 220 and the mattress 20 in a longitudinal direction. Accordingly, when the top plate 220 is actuated between the lowered position 80 and the raised position 82, the mattress 20 is prevented from sliding with respect to the mattress support 40.

Figure 11:
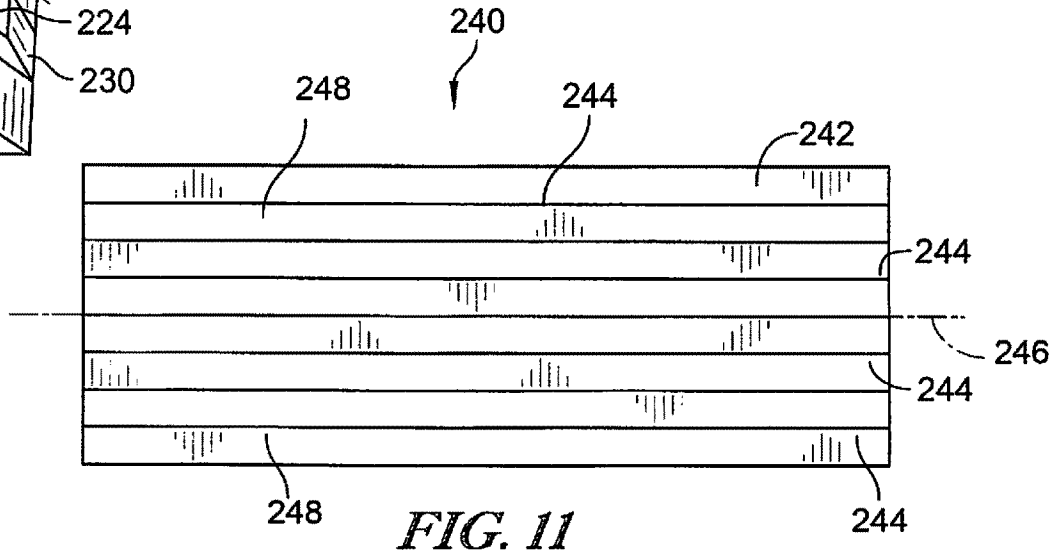
FIG. 11 is a perspective view of an exemplary base plate that may be used with the mattress support shown in FIG. 1.

An embodiment of a base plate 240 for the mattress support 40 is illustrated in FIG. 11. The base plate 240 may be either left base plate 110 or right base plate 112. The base plate 240 includes a bottom surface 242 having a plurality of runners 244 extending parallel to a lateral axis 246. Although a plurality of runners 244 are illustrated, the base plate 240 may have any number of runners 244 extending outwardly from the bottom surface 242. The runners 244 include a smooth bottom surface 248, e.g. a plastic surface, smoothed wood, or the like.

The bottom surface 248 of each runner 244 reduces a friction between the base plate 240 and the frame 12 so that a patient, a family member, or a healthcare provider can slide the mattress support 40 under the mattress 20. Notably, when the mattress support 40 is positioned under the mattress 20, the runners 244 increase a friction between the base plate 240 and the frame 12 in a longitudinal direction. Accordingly, when the top plate 220 is actuated between the lowered position 80 and the raised position 82, the mattress support 40 is prevented from sliding with respect to the frame 12.

Although this disclosure refers to multiple embodiments, it will be appreciated that aspects of each embodiment may be utilized with other embodiments described herein.

Although this disclosure refers to specific embodiments, it will be understood by those skilled in the art that various changes in form and detail may be made without departing from the subject matter set forth in the accompanying claims.

The invention claimed is:

1. A mattress support comprising: a base plate, a bladder coupled to a top surface of the base plate, a top plate coupled to a top surface of the bladder and configured to pivot relative to the base plate about a pivot axis, a top surface of the top plate being configured to support a mattress, wherein the bladder is inflatable to adjust a height of the top plate, and wherein the top plate includes a coupling mechanism that includes an interlocking joint configured to enable the mattress support to be folded about an axis perpendicular to the pivot axis, wherein: the top plate includes a first half coupled to a second half by the coupling mechanism, the bladder includes a first bladder coupled to the first half of the top plate and a second bladder coupled to the second half of the top plate, and the base plate includes a first half coupled to the first bladder and a second half coupled to the second bladder.

2. The mattress support of claim 1, wherein, when the mattress support is folded, a top surface of the first half of the top plate is positioned confronting a top surface of the second half of the top plate.

3. The mattress support of claim 2, wherein, when the mattress is folded, the first bladder and the first half of the base plate are positioned adjacent the first half of the top plate and the second bladder and the second half of the base plate are positioned adjacent the second half of the top plate.

4. The mattress of claim 1, further comprising: a first side panel coupled to the first half of the top plate, the first side panel being configured to couple to a first side rail, and a second side panel coupled to the second half of the top plate, the second side panel being configured to couple to a second side rail.

5. The mattress support of claim 1, wherein the bladder is inflated to adjust an angle of the top plate relative to a longitudinal axis of the mattress support.

6. The mattress support of claim 1, further comprising a side panel coupled to the top plate.

7. The mattress support of claim 6, wherein the side panel is configured to couple to a side rail.

8. The mattress support of claim 6, wherein the side panel includes a first side panel coupled to a first side of the top plate, the first side panel being configured to couple to a first side rail, and a second side panel coupled to a second side of the top plate, the second side panel being configured to couple to a second side rail.

9. The mattress support of claim 1, further comprising a runner extending along the top surface of the top plate.

10. The mattress support of claim 9, wherein the runner extends laterally along the top surface of the top plate.

11. The mattress support of claim 1, further comprising a plurality of runners extending laterally along the top surface of the top plate.

12. A mattress support comprising: a base plate, the base plate having a first half and a second half, a first elevation assembly coupled to the first half of the base plate and a second elevation assembly coupled to the second half of the base plate, a top plate having a first half and a second half, the first half of the top plate coupled to the first elevation assembly and the second half of the top plate coupled to the second elevation assembly, a coupling mechanism coupling the first half of the top plate and the second half of the top plate, the coupling mechanism including an interlocking joint having a first notch and a first tab formed on the first half of the top plate, and a second notch and a second tab formed on a second half of the top plate, the first tab engageable with the second notch and the second tab engageable with the first notch such that the first and second halves of the top plate configured to be mated to move together and to enable the mattress support to be folded when the first and second halves of the top plate are separated.

13. The mattress support of claim 12, wherein the first elevation assembly is a first bladder and the second elevation assembly is a second bladder.

14. The mattress support of claim 13, wherein the first bladder and the second bladder are inflated to adjust an angle of the top plate relative to a longitudinal axis of the mattress support.

15. The mattress support of claim 12, wherein, when the mattress support is folded, a top surface of the first half of the top plate is positioned to confronting a top surface of the second half of the top plate.

16. The mattress support of claim 15, wherein, when the mattress is folded, the first elevation assembly and the first half of the base plate are positioned adjacent the first half of the top plate and the second elevation assembly and the second half of the base plate are positioned adjacent the second half of the top plate.

17. The mattress of claim 12, further comprising:

a first side panel coupled to the first half of the top plate, and a second side panel coupled to the second half of the top plate.

18. The mattress support of claim 17, wherein:

the first side panel is configured to couple to a first side rail, and the second side panel is configured to couple to a second side rail.

19. The mattress support of claim 12, further comprising a runner extending along the top surface of the top plate.

20. The mattress support of claim 19, wherein the runner extends laterally along the top surface of the top plate.

21. The mattress support of claim 12, further comprising a plurality of runners extending laterally along the top surface of the top plate.

* * * * *